US006921074B2

(12) United States Patent
Cavallo

(10) Patent No.: US 6,921,074 B2
(45) Date of Patent: Jul. 26, 2005

(54) BOARD GAME

(76) Inventor: Frances I. Cavallo, 6352 Rte. 25A, Wading River, NY (US) 11792

( * ) Notice: Subject to any disclaimer, the term of this patent is extended or adjusted under 35 U.S.C. 154(b) by 216 days.

(21) Appl. No.: 10/617,926

(22) Filed: Jul. 11, 2003

(65) Prior Publication Data

US 2005/0006844 A1 Jan. 13, 2005

(51) Int. Cl.[7] ..... A63F 3/00
(52) U.S. Cl. ..... 273/272; 434/167
(58) Field of Search ..... 273/272, 299, 273/287; 434/167

(56) References Cited

U.S. PATENT DOCUMENTS

| | | | | |
|---|---|---|---|---|
| 3,594,003 A | * | 7/1971 | Elder | 273/272 |
| 4,014,548 A | | 3/1977 | Trilling | 273/135 D |
| 4,341,387 A | | 7/1982 | Freyman | 273/240 |
| 4,637,609 A | | 1/1987 | Vanderhoof | 273/272 |
| 4,892,319 A | | 1/1990 | Johnson | 273/272 |
| 4,896,889 A | * | 1/1990 | Kuhn et al. | 273/272 |
| 5,139,271 A | | 8/1992 | Bez | 273/272 |
| 5,312,112 A | | 5/1994 | Cohen | 273/272 |
| 5,374,065 A | | 12/1994 | Motskin | 273/272 |
| 6,367,798 B1 | | 4/2002 | Lawal | 273/272 |
| 6,378,868 B1 | | 4/2002 | La Bossiere | 273/272 |
| 6,422,561 B1 | | 7/2002 | Schroeder | 273/272 |

* cited by examiner

*Primary Examiner*—William M Pierce

(57) ABSTRACT

A board game wherein players make words from multiple letter tiles. Unlike prior word games, the player must construct words of a particular number of letters, which correspond to numbers appearing on the game board. Each player has a colored moving game piece, and starts with 6 letters. Upon making a word of a number of letters shown on the board (shown to the other players), the player is allowed to move the piece diagonally or horizontally to the number on the board. Each of the 4 possible players begins with the game piece at the colored "start" side of the board, and the object is to move the player piece inward, toward the center of the board, to achieve victory. The players may also challenge the spelling of words made by their opponents, in the preferred mode of playing the game. If the challenger is correct, the player loses his or her turn, and if the challenger is incorrect, the challenger loses his or her turn. In addition, players may pass when unable to form words of a required number of letters. Finally, player must form a 7 letter word in order to move to the number "7" center area of the board, resulting in victory.

18 Claims, 2 Drawing Sheets

BOARD GAME

BACKGROUND OF THE INVENTION

1. Field of the Invention

The present invention is a board game, wherein players make words from multiple letter tiles. Unlike prior word games, the player must construct words of a particular number of letters, which correspond to numbers appearing on the game board. Each player has a colored moving game piece, and starts with 6 letters. Upon making a word of a number of letters shown on the board (shown to the other players), the player is allowed to move the piece diagonally or horizontally to the number on the board. Each of the 4 possible players begins with the game piece at the colored "start" side of the board, and the object is to move the player piece inward, toward the center of the board, to achieve victory. The players may also challenge the spelling of words made by their opponents, in the preferred mode of playing the game. If the challenger is correct, the player loses his or her turn, and if the challenger is incorrect, the challenger loses his or her turn. In addition, players may pass when unable to form words of a required number of letters. Finally, player must form a 7 letter word in order to move to the number "7" center area of the board, resulting in victory.

2. Description of the Prior Art

Numerous innovations for board games have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 6,422,561, invented by Schroeder, entitled "Word Search Based Board Game With Directional Tiles"

The patent to Schroeder describes a word search based game including a playing surface divided into individual playing cells and a plurality of both alphanumeric playing and directional instruction tiles. The alphanumeric tiles are placed on the playing surface in a manner to form word following a word search format, that is to say words may be forwards or backwards, vertically, horizontally or diagonally and do not necessarily have to form words with every alphanumeric playing tile that happens to be adjacent on the board to the played alphanumeric playing tiles. Directional instruction tiles are of the same size, shape and color as the alphanumeric playing tiles so that they may be drawn at random with alphanumeric playing tiles, but indicate a desired direction in which to form a word and a bonus multiplier if a word follows said direction. Also provided are a plurality of category cards, one drawn at the start of a game, to provide a scoring bonus to words formed which meet the category. The game is adaptable to both a traditional board game format and a computerized format.

2. U.S. Pat. No. 6,378,868, invented by La Bossiere, entitled "Word Game"

The patent to La Bossiere describes a game in which each player randomly draws playing tiles, either blank or letter displaying, from a receptacle and constructs words with them, positioning them on her personal viewing area, with play transferring from player to player. At the end of her turn, each player enters her score and replenishes her playing tiles. Players can remove ("steal") other players' playing tiles to construct at least one new word by adding at least one additional playing tile at her own personal viewing area. Play continues until the end of the game determined when all of the playing tiles have been removed and when none of the players can any longer construct a word with the playing tiles at the personal viewing areas. A basic score is achieved by placing a value of one on each tile used in a new word plus each tile reused to reveal additional words within that new word.

3. U.S. Pat. No. 6,367,798, invented by Lawal, entitled "Word Game"

In the patent to Lawal, a word game and method of playing the word game is described. The word game has a plurality of letter indicator members, each having a letter indicia corresponding to a selected letter or choice of letter, each letter indicia being assigned a predetermined point value for use in calculating an initial score value of a word formed from a random selection of the letter indicia. The game further includes a plurality of score manipulation members, each having a scoring indicia for manipulating the initial score value and determining a final score of the word. The score manipulation members are arrangeable in a random order from one game to the next.

4. U.S. Pat. No. 5,374,065, invented by Motskin, entitled "Method Of Playing A Word Forming Board Game"

The patent to Motskin describes a language building game for two to four players utilizing a grid marked game playing board, a pool of playing tiles each bearing a letter of the alphabet on its face, and a scoring sheet for each player. The game method includes placing a first plurality of tiles on the board by a first player, placing only a single tile on the board adjacent to the first plurality of tiles by the second player, wherein the first and second players continue to build about the first plurality of tiles and the single tile by placing additional pluralities of tiles on the board.

5. U.S. Pat. No. 5,312,112, invented by Cohen, entitled "Word Forming Board Game Including Elements Of Conflict"

Cohen's invention is a board game for two players or teams which includes elements of the games of scrabble and chess as well as other novel features, and includes a game board having a pattern of lettered playing spaces and a plurality of differently configured playing pieces or markers for each player or team. The differently configured playing pieces or markers are assigned patterns for their moves on the board depending upon their configuration. The pieces/markers are alternatingly moved to various lettered spaces on the board to claim letters for use in forming words. Points are awarded for each letter used in the formation of a word. A further aspect of the game is that no markers or pieces are ever captured or removed from play, even though the rules allow two opposing pieces to occupy the same space under certain circumstances. Other rules provide for skipping a turn or skipping the use of a letter under certain circumstances, and for the doubling or tripling of the point value for a letter when a marker is moved to a space already occupied by an opposing player's marker, depending upon the rank of the opposing marker. The configuration of some of the markers provides for the vertical stacking of two of those markers on the same space of the board.

6. U.S. Pat. No. 5,139,271, invented by Bez, entitled "Board Game"

In the patent to Bez, an educational tool in the form of a word game is disclosed. Each player starts on his own colored starting point at the bottom of the game area. Each player is represented by a colored alphabet set of blocks that are selected before the start of the game. During successive turns, the players must travel up and across the board by forming words while using one letter from the previous word, and must return the remaining letters to a return section of a tray with the letters facing down. All the letters used by a player from his selector holder to form a word must be substituted by the letters from a surplus section of a supply tray. To accomplish their goal and win the game, the players must enter their respective color goal or finish point on the top of the game area. If in a turn more than one player reaches his goal, the winner will be the one having the most letters in his color goal.

7. U.S. Pat. No. 4,892,319, invented by Johnson II, entitled "Word Game"

In the patent to Johnson, an apparatus for a word game is disclosed. A game board surface is divided into a number of squares into which playing pieces containing the letters of the alphabet are placed to complete a word. The various words are contained in groups which, when of a certain size, are considered to be an island which creates the right to start a new word independent from all the other which is an atoll. Except for atolls and the beginning of the game, any new letters added must form a word with those letters already on the playing field. New words which link one island to another island or atoll are isthmuses and capture the island or atoll to which they are linked as part of the territory for the player creating such an isthmus. Two iscosahedron dice having their faces numbered from 1 to 20 are used to randomly select numbers from 2 to 40. These numbers are related to the letters of the alphabet by a decoder with the frequency of number approximating the frequency of the use of the letters in making words. The seldom used letters of the alphabet are increased through the use of a number of bonus letters and the value of the individual letters vary based on a scoring code. The individual ownership Of Atolls, Isthmuses And Islands is shown by a color-coded transparent flag placed on top of one of the previously played letters.

8. U.S. Pat. No. 4,637,609 invented by Vanderhoof, entitled "Method For A Game"

The Vanderhoof patent describes a method and apparatus for a game in which a plurality of word-building structures, each having a plurality of playing spaces, are disposed about a gameboard. The preferred word-building structure comprises a pyramid shaped grid having 49 playing spaces. The pyramid is arranged in seven rows, with thirteen playing spaces in the base row and two less playing spaces in each succeedingly higher row. A word-building structure is associated with each respective competitor, as well as a color-coded set of playing pieces containing alphanumeric characters. These pieces are used by each competitor for building words in the horizontal, vertical, and diagonal directions in his respective word-building structure during a three minute word-building phase. The game board is then rotated to place each competitor in front of an opponent's word-building structure for an offensive phase, during which a competitor may strategically place his playing pieces to block selected spaces adjacent previously built words on an opponent's structure, thereby limiting the opponent's use of the blocked spaces in subsequent word-building phases and capturing the scoring value of the blocked words. Play continues with alternating word-building phases and offensive phases until one of a set of predetermined conditions occurs. Scores are tallied at the end of a game, at which time the point values of words are determined and the final determination of their ownership is made.

9. U.S. Pat. No. 4,341,387, invented by Freyman, entitled "Board Word Game Apparatus And Method"

In the patent to Freyman, a playing board is divided into a number of discrete playing areas bearing respective numerals in a reading sequence. A plurality of game pieces such as cards or tiles, whose aggregate number approximates the number of the areas, respectively bear letters of the alphabet. The number of game pieces bearing a particular letter corresponds generally to the normal frequency of occurrence of that letter. The player makes a plurality of random draws of a certain number of the tiles and, attempting to form words or parts of words, places them on respective areas of the board in relative positions that form words or are likely to form parts of words in subsequent plays of subsequent draws. Each play of a draw is playable only in areas having higher numbers than those played in a previous draw except when a play can no longer be so made whereupon play can be made in low numbered areas toward the beginning of the board.

10. U.S. Pat. No. 4,014,548 invented by Trilling, entitled "Word Game Having Single And Multiple Letter Tiles"

The Trilling word game includes multiple-letter tiles as well as single-letter tiles which are placed on successive spaces on a playing board. In order to receive score points, each player attempts to compose words on his own playing board on which is printed a single row of letter spaces. One of the letter spaces, designated as a "master space", has placed thereon a randomly selected multiple-letter tile. Words are composed by locating single-letter tiles in successive letter spaces on the board so that the single-letter tiles merge with the multiple-letter tile. Each of the letter spaces is assigned a score point value, the magnitude of which depends upon distance to the master space. The score point value of a composed word is equal to the sum of the assigned score point values of the starting and ending spaces of the word. Bonus points are awarded when a joker tile used in composing a word falls on a "joker" space. A timer is provided to limit the time permitted a player for composing a word in order to speed up the playing action.

The relevant prior patents described above largely entails items such as: word forming games that are based on numerical point scoring; games in which players must move pieces in a circular pattern around a board; games in which a player begins by placing a single letter on a board and other players are required to build upon that letter; a combination Scrabble® and chess game where players challenge one another to gain control of particular spaces on the board; board games where players build words three-dimensionally in a pyramid shape; and various board games based upon crossword puzzles.

In contrast, in the present invention players make words of a particular number of letters which correspond to numbers appearing on a game board. Upon making a word of a number of letters shown on the board, the player moves a piece diagonally or horizontally to the number on the board. The object is to move the player piece inward, toward the center of the board, to form a 7 letter word in order to move to the number "7" center area of the board, resulting in victory.

SUMMARY OF THE INVENTION

As noted, the present invention is a board game, wherein players make words from multiple letter tiles. Unlike prior word games, the player must construct words of a particular number of letters, which correspond to numbers appearing on the game board. Each player has a colored moving game piece, and starts with 6 letters. Upon making a word of a number of letters shown on the board (shown to the other players), the player is allowed to move the piece diagonally or horizontally to the number on the board. Each of the 4 possible players begins with the game piece at the colored "start" side of the board, and the object is to move the player piece inward, toward the center of the board, to achieve victory. The players may also challenge the spelling of words made by their opponents, in the preferred mode of playing the game. If the challenger is correct, the player loses his or her turn, and if the challenger is incorrect, the challenger loses his or her turn. In addition, players may pass when unable to form words of a required number of letters. Finally, player must form a 7 letter word in order to move to the number "7" center area of the board, resulting in victory.

In light of the foregoing, it is generally an object of the present invention to provide a challenging and entertaining game that functions differently than board games of the prior art.

It is another object of the present invention to provide a word game that is educational in nature.

It is also an object of the invention to provide a game that may be played by players of many ages, including children.

It is a further object of the invention to provide a game that takes up relatively small space, rendering same suitable for play in a variety of places.

It is an additional object of the invention to provide a board game that may be three dimensional in nature, wherein players must "climb" towards the elevated center of the board to achieve victory.

It is a further object of the invention to provide a game that may be played in an electronic format, such as on a computer or other electronic device.

Finally, it is an additional object of the invention to provide a game that is relatively inexpensive to manufacture.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
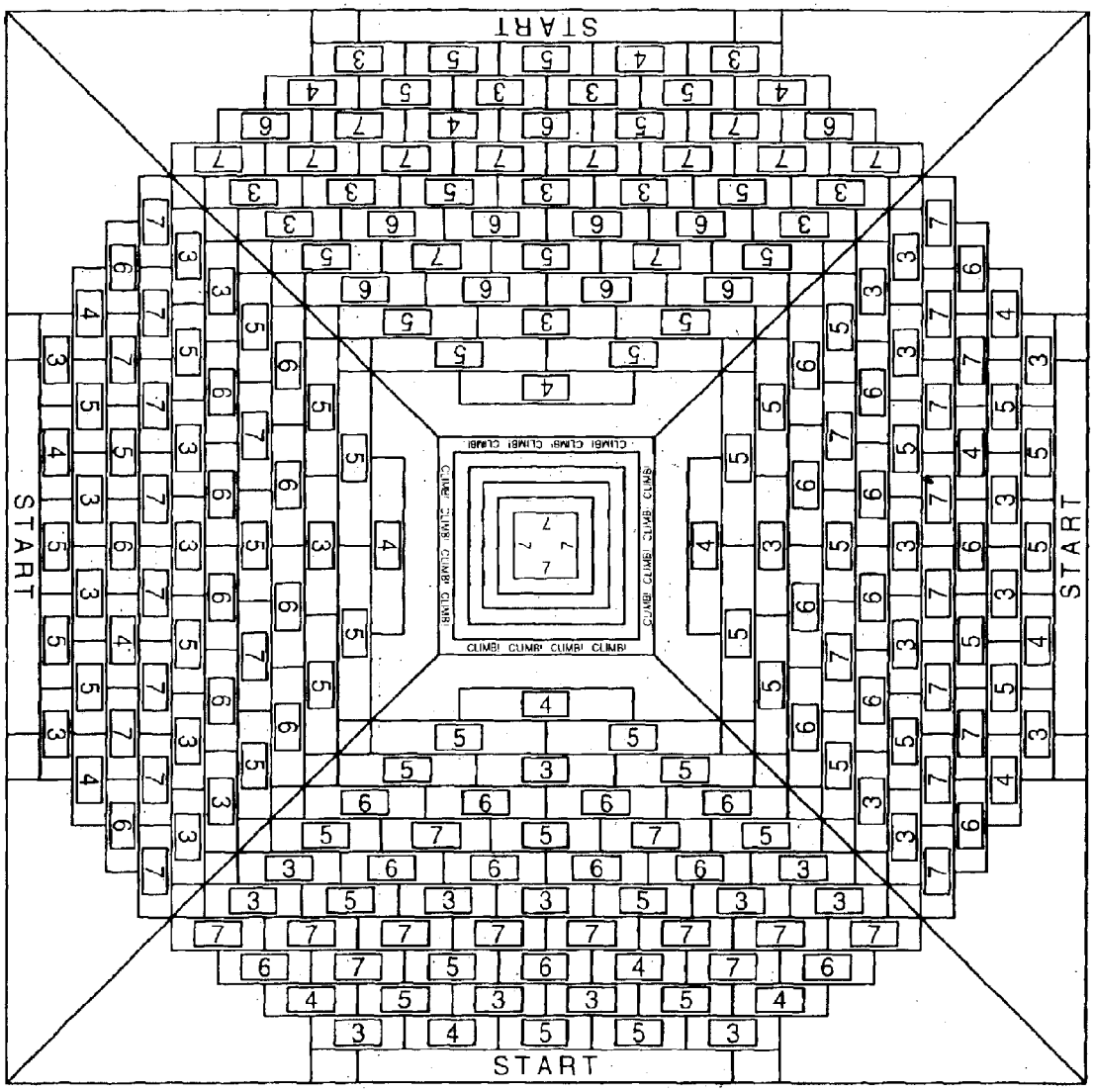
FIG. 1 is a top plan view of the game board of the present invention, illustrating starting point, eleven rows of numbered boxes, and center portion, for the purposes of example only.
Figure 2:
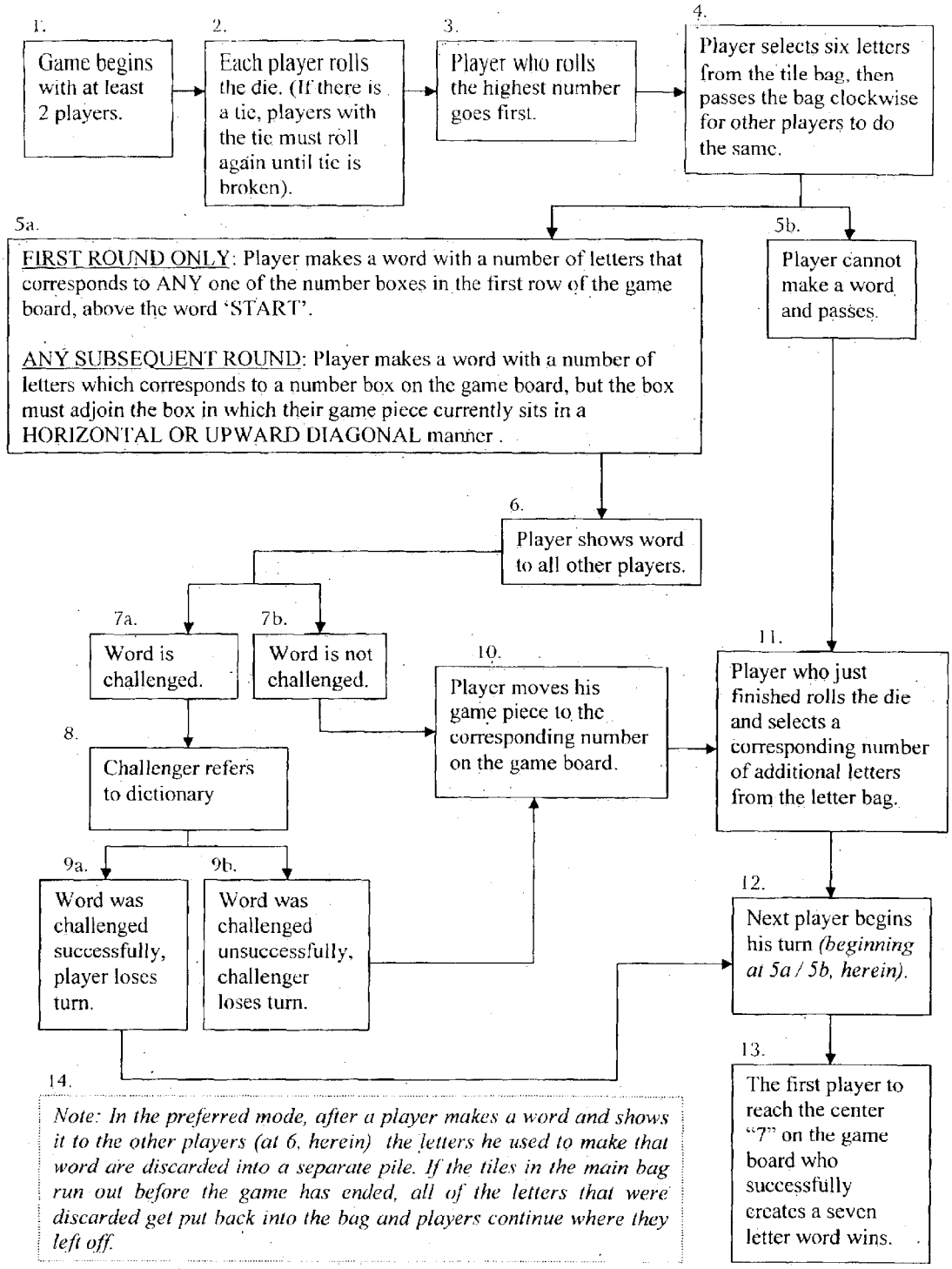
FIG. 2 is a flow chart describing the preferred method of playing the board game of the present invention, including several optional rules which may be used in the game, for the purposes of example only.

Referring to: FIG. 1, which is a top plan view of the game board of the present invention, illustrating starting point, eleven rows of numbered boxes, and center portion, for the purposes of example only, and FIG. 2, which is a flow chart describing the preferred method of playing the board game of the present invention, including several optional rules which may be used in the game, for the purposes of example only:

In the preferred method of play, the game begins with at least 2 players. Importantly, 2 to 4 players may play the game. Each player rolls a die to determine the player who is to go first. The player with the highest number goes first, but if there is a tie, the players with the tie must roll again until the tie is broken.

The first player then takes a previously-determined quantity of letters from a bag of letters. In the preferred mode, each player takes 6 letters from the tile bag. The first player then passes the bag to the other players to select their letters. In the preferred method of play, the first player passes the bag clockwise to the next player. Likewise, the players take their turns clockwise during the game.

Regarding the method of playing the first round of the game only, the first player makes a word with a particular quantity of letters. The quantity of letters must correspond to a number located in a particular location upon the game board. Specifically, the generally square board comprises multiple rows of boxes, each of which bear a number. A first row of number boxes is located immediately above the word "START" on the game board, where the player begins with a previously-determined movable piece.

In the preferred mode, the first row of the game board comprises 5 boxes, which bear the numbers "3," "5," "5," "3," and "6." Although other quantities of rows may be utilized, in preferred mode the board comprises 11 rows of numbered boxes, as shown in FIG. 1. Generally, the smallest row contains a single numbered box, which may be the last row before the center box. The largest row may have 8 numbered boxes, giving the player significant latitude in choosing where to next move their game piece.

It should also be noted that the board may comprise many colors and graphics thereon. For the purposes of example only, each row may be a different color, each box bearing the same number may bear the same color, or the side of the board corresponding to each player may bear a special color.

In each subsequent round of play, each player makes a word with a number of letters which corresponds to an additional number box on the game board. At this point, the box to which the user seeks to move must adjoin the box at which their game piece currently sits, and must adjoin same in a horizontal or upward diagonal manner. This generally allows for upward movement of the game piece towards the center of the game board.

In any round of play, after making a word of an appropriate quantity of letters, the player shows the word to all other players. Such may conveniently be shown on the rack on which the word is formed. In the preferred method, if a player cannot make a word, that player passes to the next player in the clockwise pattern, and rolls the die to select a corresponding quantity of letter tiles.

In the preferred mode, after a player makes a word and shows it to the other players, the letters he or she used to make that word are discarded into a separate pile. If the tiles in the main bag run out before the game has ended, all of the letters that were discarded may be put back into the bag, allowing players to continue where they left off.

Moreover, in the preferred mode of play, any player may challenge whether or not another player's proposed word is acceptable (i.e. is not slang or an abbreviation). In such instance, the challenging player refers to a previously-determined dictionary to verify the accuracy of the word, such as if the spelling is correct, or to confirm that the word is not slang or an abbreviation.

If the word is challenged successfully (the proposed word is not allowable), the player who made the word loses a turn. However, if the word was challenged unsuccessfully (the proposed word was allowable), the challenging loses his or her turn. As such, the risk of losing a turn will function to act as a deterrent from players challenging words too often, which could potentially slow the pace of the game.

If the word is not challenged, or the word is challenged unsuccessfully, the player then moves his or her game piece to the corresponding number on the game board. Next, the player who just finished rolls the die and selects a corresponding number of additional letters from the letter bag.

At this time, the next player begins his or her turn by trying to form a word with an amount of letters that corresponds to a number on an acceptable box on the game board, in the manner described above.

The game continues according to the method outlined above, and the first player to reach the center of the game board wins the game. In the preferred mode, the center box bears a number that is challenging and difficult for the players to achieve. Specifically, the center box bears the number "7," and the winning player must make a 7-letter word in order to move to the center box to win the game. As such, the final step provides a fun and challenging finale to the game.

It should be noted that the above method of playing the game allows for a game of an appropriate length of time, such as approximately on hour of play. Such provides lengthy entertainment for the players, without acting as a disincentive to participate in the game.

Regarding enhanced embodiments, the board game may be three dimensional in nature, wherein players must "climb" towards an elevated center box of the board in order to achieve victory. This will add interest to the game, as well as provide a unique appearance of the game assembly.

Moreover, utilizing the same rules and concepts, the game may be transferred to an electronic format, to be played upon a computer or other electronic device. As such, the game may be played via computer network by multiple players.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in anyway from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A method of playing a board game utilizing a generally square game board which comprises multiple rows of boxes, each box bearing a number thereon; the method comprising the steps of:

players rolling a die to determine a player who is to go first;

a first player taking a previously-determined quantity of letter tiles from a bag of letter tiles;

the first player passing the bag to other players to select their letters;

the first player making a word with a particular quantity of letters that corresponds to a number located in a previously-determined location upon a game board;

a first row of number boxes located immediately above the word "START" on the game board, where the player begins with a previously-determined movable game piece;

the first player showing the word to all other players;

the first player moving the previously-determined movable game piece to the box bearing the number corresponding to the length of the word made;

the first player's letter tiles discarded into a pile;

the first player rolls the die and selects a corresponding number of additional letters from the letter bag;

each subsequent player making a word with a number of letters which corresponds to a previously-determined number box on the game board;

the box to which the user seeks to move adjoining the box at which their game piece currently sits, in a horizontal or upward diagonal manner, functioning to allow for upward movement of the game piece towards a center box of the game board;

the center box bearing a previously-determined number, the first player to reach the center box by making a word of a quantity of letters corresponding thereto winning the game.

2. The method of playing a board game as described in claim 1, wherein the game is played by two, three, or four players.

3. The method of playing a board game as described in claim 1, wherein each player selects six letters to begin the game.

4. The method of playing a board game as described in claim 1, wherein a player must make a seven letter word to enter the center box of the game board to achieve victory.

5. The method of playing a board game as described in claim 1, wherein the total number of letter tiles utilized is two hundred sixty eight.

6. The method of playing a board game as described in claim 1, wherein the center box of the game board comprises a logo with the name of the board game.

7. The method of playing a board game as described in claim 1, wherein the game is produced in a compact travel size.

8. The method of playing a board game as described in claim 1, wherein the game is played in a computer-generated or electronic format.

9. The method of playing a board game as described in claim 1, wherein the game is three dimensional in nature, with the center box located above the outer edges of the game board.

10. The method of playing a board game as described in claim 1, wherein a user who can not make a word must pass his or her turn to the next player, and roll the die to select a corresponding quantity of letter tiles for future usage.

11. The method of playing a board game as described in claim 1, wherein each player uses a tile rack with three tiers or four tiers.

12. The method of playing a board game as described in claim 1, wherein the first row of boxes on the game board comprise the numbers "3," "5," "5," "3," and "6".

13. The method of playing a board game as described in claim 1, wherein any player may challenge whether another player's proposed word is acceptable.

14. The method of playing a board game as described in claim 13, wherein the challenging player refers to a previously-determined dictionary to verify the accuracy of the word.

15. The method of playing a board game as described in claim 13, wherein if the word is challenged successfully, the player who made the word loses a turn.

16. The method of playing a board game as described in claim 13, wherein if the word was challenged unsuccessfully, the challenging player loses his or her turn.

17. The method of playing a board game as described in claim 1, wherein if a player cannot make a word, that player rolls the die, selects a corresponding number of letter tiles, and passes to the next player.

18. The method of playing a board game as described in claim 1, wherein if the letters tiles in the bag run out before the game has ended, all of the discarded letters are put back into the bag, allowing players to continue where they left off.

* * * * *